US009150810B2

(12) United States Patent
Kurosawa et al.

(10) Patent No.: US 9,150,810 B2
(45) Date of Patent: Oct. 6, 2015

(54) LUBRICATING OIL ADDITIVE AND LUBRICATING OIL COMPOSITION

(75) Inventors: Osamu Kurosawa, Tokyo (JP); Yasushi Onumata, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 13/583,722

(22) PCT Filed: Mar. 15, 2011

(86) PCT No.: PCT/JP2011/056067

§ 371 (c)(1),
(2), (4) Date: Sep. 10, 2012

(87) PCT Pub. No.: WO2011/115116

PCT Pub. Date: Sep. 22, 2011

(65) Prior Publication Data

US 2013/0005632 A1 Jan. 3, 2013

(30) Foreign Application Priority Data

Mar. 16, 2010 (JP) ..... 2010-059644

(51) Int. Cl.
*C10L 1/22* (2006.01)
*C10M 133/16* (2006.01)

(52) U.S. Cl.
CPC ..... *C10M 133/16* (2013.01); *C10M 2203/102* (2013.01); *C10M 2203/1006* (2013.01); *C10M 2203/1025* (2013.01); *C10M 2215/08* (2013.01); *C10M 2215/082* (2013.01); *C10M 2215/086* (2013.01); *C10M 2215/28* (2013.01); *C10M 2219/046* (2013.01); *C10M 2223/049* (2013.01); *C10N 2220/022* (2013.01); *C10N 2230/06* (2013.01); *C10N 2230/52* (2013.01); *C10N 2230/54* (2013.01); *C10N 2230/74* (2013.01); *C10N 2230/76* (2013.01); *C10N 2240/045* (2013.01)

(58) Field of Classification Search
CPC ..... C10M 13/16
USPC ..... 508/550, 551
See application file for complete search history.

(56) References Cited

U.S. PATENT DOCUMENTS 4,512,903 A * 4/1985 Schlicht et al. ..... 508/555
2009/0312207 A1 12/2009 Bartley et al.

FOREIGN PATENT DOCUMENTS

| | | | |
|---|---|---|---|
| CN | 101421380 | | 4/2009 |
| JP | 2000-355695 | A | 12/2000 |
| JP | 2001-513140 | A | 8/2001 |
| JP | 2009-13408 | A | 1/2009 |
| JP | 2009-511716 | A | 3/2009 |
| JP | 2009-520085 | A | 5/2009 |
| JP | 2009-120760 | | 6/2009 |
| JP | 2009-533536 | A | 9/2009 |
| JP | 2009-286831 | A | 12/2009 |

OTHER PUBLICATIONS

China Office action, mail date is Apr. 2, 2013.
International Search Report issued with respect to PCT/JP2011/056067, mailed May 31, 2011.
English-language translation of International Preliminary Report on Patentability issued with respect to PCT/JP2011/056067, mailed Nov. 1, 2012.
Office Action for EP Patent Application No. 11756301.5, which was mailed on Jul. 4, 2014.
"Technical Information Surface Chemistry Akzo Nobel Surface Chemistry LLC Armeen Products Description of Product Families and Application Areas," 2008, pp. 1-7, retrieved from the internet: http://sc.akznobel.com/en/fa/Documents/AkzoNobel_tb_ArmeenProducts.pdf.

* cited by examiner

*Primary Examiner* — Prem C Singh
*Assistant Examiner* — Francis C Campanell
(74) *Attorney, Agent, or Firm* — Greenblum & Bernstein, P.L.C.

(57) ABSTRACT

An additive for lubricating oil of the present invention contains an amide compound represented by the following general formula (1). A lubricating oil composition of the present invention contains: a lubricating base oil containing a mineral base oil and/or a synthetic base oil; and an amide compound represented by the following general formula (1).

$$R^1R^2N—COCH_2OH \quad (1)$$

(In the general formula (1), $R^1$ and $R^2$ may be the same or different and each represents an alkyl group having 16 to 22 carbon atoms.)

1 Claim, No Drawings

LUBRICATING OIL ADDITIVE AND LUBRICATING OIL COMPOSITION

TECHNICAL FIELD

The present invention relates to an additive for lubricating oil and a lubricating oil composition. In particular, the present invention relates to an additive for lubricating oil and a lubricating oil composition which contain an amide compound having a specific structure, have an excellent shudder life, have a high intermetallic friction coefficient, and are suitably used for an automatic transmission having a wet clutch, particularly a continuous variable transmission including a metal belt or a metal chain and a pulley.

BACKGROUND ART

Continuous variable transmission (CVT) mechanism is applied to a motor vehicle for the purpose of improving the fuel efficiency of the motor vehicle. A lubricating oil for the CVT may be referred to as a continuous variable transmission fluid (CVTF).

A lubricating oil composition containing a lubricant oil base oil, an imide compound, an amide compound, and an aliphatic amine compound wherein the content of the imide compound is 300 to 1,000 ppm by mass in terms of nitrogen based on the total amount of the composition; the content of the amide compound is 380 to 1,300 ppm by mass in terms of nitrogen based on the total amount of the composition; and the content of the aliphatic amine compound is 35 to 360 ppm by mass in terms of nitrogen based on the total amount of the composition is disclosed in Patent Literature 1, for the purpose of providing a lubricating oil composition capable of achieving both a high transmission torque capacity and a transmission shock preventing property in engagement of a clutch in an automatic transmission such as a multistage transmission or a continuous variable transmission.

A lubricating oil composition containing a lubricating base oil, an oil-soluble source of phosphorus, and a defined polyalkylene polyamine-based friction-improving agent reacted with an acylating agent which converts at least one secondary amino group into an amide is disclosed in Patent Literature 2, for the purpose of providing an additive composition useful for providing a lubricating oil, specifically a transmission fluid, for example, an automatic transmission fluid ("ATF"), a continuous variable transmission fluid ("CVTF"), and a double-clutch transmission fluid ("DCTF") with excellent friction stability, and more specifically, useful for providing the transmission fluid with an excellent friction characteristic during high-speed clutch engagement.

A lubricating composition for lubricating a continuously variable transmission, containing a mixture of a major amount of a lubricating oil and an effective amount of a combination of performance enhancing additives containing: (a) at least one organic phosphite; (b) at least one amine salt of an organic phosphate; and (c) one or more friction modifiers selected from the group consisting of (1) an amide, (2) a succinimide, and (3) an ethoxylated amine is disclosed in Patent Literature 3.

A lubricating oil composition for a continuous variable transmission in which (A) Ca salicylate, (B) a phosphorus antiwear agent, (c) a friction modifier, and (D) a dispersion-type viscosity index improver are contained in a lubricating base oil containing a mineral oil and/or a synthetic oil is disclosed in Patent Literature 4, for the purpose of providing a lubricating oil composition for a continuous variable transmission which achieves both a high intermetallic friction coefficient required for a belt type CVT fluid and a shudder-preventing property to a slip control mechanism and can be used for a long term.

A lubricating oil composition for a metal belt type continuous variable transmission in which a phosphorus compound having a specific structure or a derivative thereof is contained in an amount of 0.005 to 0.1% by mass as phosphorus element amount based on the total amount of the composition in a lubricating oil base oil containing a mineral base oil and/or a synthetic base oil, to enable the achievement of a high intermetallic friction coefficient between a belt and a pulley and to have an excellent transmission characteristic is disclosed in Patent Literature 5.

CITATION LIST

Patent Literature

Patent Literature 1: Japanese Patent Application Laid-Open Publication No. 2009-120760

Patent Literature 2: Japanese Patent Application Laid-Open Publication No. 2009-013408

Patent Literature 3: Japanese Patent Application Laid-Open Publication No. 2001-513140

Patent Literature 4: Japanese Patent Application Laid-Open Publication No. 2000-355695

Patent Literature 5: Japanese Patent Application Laid-Open Publication No. 2009-286831

SUMMARY OF INVENTION

Technical Problem

The metal belt type continuous variable transmission is a transmission which transmits torque using friction between a metal belt and a metal pulley and has a mechanism changing the radius ratio of the pulley to perform transmission. In recent years, the metal belt type continuous variable transmission has been spotlighted as a motor vehicle transmission from the view point of less energy loss caused by the transmission. An excellent friction characteristic and lubricating characteristic between the metal belt and the metal pulley are extremely stressed as the lubricating oil used for the metal belt type continuous variable transmission, and performance as a lubricating oil for gears taking out torque and bearings supporting the gears, and performance as a hydraulic pressure control medium for determining a transmission ratio, that is, performance as a hydraulic operating oil are also required. When the continuous variable transmission is provided with a forward and reverse travel changing wet clutch or a lock-up system of a torque converter, performance for controlling the friction characteristic of the wet clutch is also required in addition to the above performances. Thus, since various performances are required for the lubricating oil for the metal belt type continuous variable transmission, practically, the automatic transmission fluid (ATF) is generally used.

However, although the performance as the hydraulic operating oil and a function for controlling the friction characteristic of the wet clutch are excellent when the ATF is used as the lubricating oil for the metal belt type continuous variable transmission, the intermetallic friction coefficient of the belt and the pulley is not sufficient. Therefore, the conventional metal belt type continuous variable transmission using the ATF has a limited transmission torque capacity, and can be disadvantageously mounted on only a mini motor vehicle.

A higher torque transmission capacity is required with recent acceleration of requirement for improving fuel economy, by contrast, improvement in the transmission characteristic (shudder-preventing property) is also required from the aspect of ride comfort. That is, the simultaneous pursuit of conflicting requirements for maintaining a high torque transmission capacity and for improving the transmission characteristic is an unresolved issue.

The present invention has been accomplished in light of these circumstances, and its object is to provide an additive for lubricating oil and a lubricating oil composition which can achieve a high intermetallic friction coefficient between a belt and a pulley in a metal belt type continuous variable transmission, and can achieve an excellent transmission characteristic.

Solution to Problem

In order to solve the above problems, the present invention provides an additive for lubricating oil containing an amide compound represented by the following general formula (1).

$$R^1R^2N—COCH_2OH \quad (1)$$

(In the general formula (1), $R^1$ and $R^2$ may be the same or different and each represents an alkyl group having 16 to 22 carbon atoms.)

The present invention provides a lubricating oil composition containing: a lubricating base oil containing a mineral base oil and/or a synthetic base oil; and the amide compound represented by the above general formula (1).

In the lubricating oil composition of the present invention, a content of the amide compound represented by the general formula (1) is preferably 0.01 to 0.5% by mass in terms of a nitrogen atom based on the total amount of the lubricating oil composition, more preferably 0.01 to 0.25% by mass, and particularly preferably 0.02 to 0.1% by mass.

Preferably, at least one of $R^1$ and $R^2$ in the general formula (1) is an alkyl group having 16 or 18 carbon atoms, and more preferably, both $R^1$ and $R^2$ are alkyl groups having 16 or 18 carbon atoms.

Furthermore, a mixture of compounds in which $R^1$ and $R^2$ are alkyl groups having 16 or 18 carbon atoms can be used as the amide compound represented by the general formula (1). In this case, the ratio (molar ratio) of the alkyl group having 16 carbon atoms and the alkyl group having 18 carbon atoms in the mixture is preferably 1:99 to 49:51.

It is preferable that the lubricating oil composition of the present invention contains a phosphorus additive at 0.005 to 0.1% by mass in terms of phosphorous element, a calcium-based metal cleaning agent at 0.005 to 0.1% by mass in terms of calcium element, and an ashless dispersant at 0.5 to 8.0% by mass based on the total amount of the lubricating oil composition, and contains no zinc dithiophosphate.

The lubricating oil composition of the present invention can be used as a lubricating oil composition for an automatic transmission having a wet clutch, and is particularly suitable as a lubricating oil composition for a continuous variable transmission provided with a metal belt or a metal chain and a pulley.

Advantageous Effects of Invention

The present invention can provide an additive for lubricating oil and a lubricating oil composition which can achieve a high intermetallic friction coefficient between a belt and a pulley in a metal belt type continuous variable transmission, and can achieve an excellent transmission characteristic. The maintenance of a high torque transmission capacity (high metal μ) between the belt and the pulley and the prolongation of a shudder life can be achieved by using the additive for lubricating oil and the lubricating oil composition of the present invention which have an excellent characteristic; the pressing pressure of the pulley can be reduced; and fuel economy can be accordingly improved.

DESCRIPTION OF EMBODIMENTS

Hereinafter, an embodiment of the present invention will be described in detail.

First Embodiment

Additive for Lubricating Oil

An additive for lubricating oil according to a first embodiment of the present invention contains an amide compound represented by the following general formula (1).

$$R^1R^2N—COCH_2OH \quad (1)$$

(In the general formula (1), $R^1$ and $R^2$ may be the same or different and each represents an alkyl group having 16 to 22 carbon atoms.)

$R^1$ and $R^2$ in the general formula (1) are alkyl groups having 16 to 22 carbon atoms, and preferably alkyl groups having 16 to 18 carbon atoms. Preferably, at least one of $R^1$ or $R^2$ is preferably an alkyl group having 16 or 18 carbon atoms, and more preferably, both $R^1$ and $R^2$ are alkyl groups having 16 or 18 carbon atoms.

When the number of the carbon atoms of the alkyl group represented by $R^1$ and $R^2$ is less than 16, a shudder life is insufficient. This is considered to be due to the fact that an oiliness-improving effect is not sufficient. When the number of the carbon atoms of the alkyl group is greater than 22, an intermetallic friction coefficient cannot be sufficiently reduced. This is considered to be due to the fact that the adsorbability of the amide compound to the surface of a member is reduced.

Furthermore, a mixture of two or more amide compounds in which the number of the carbon atoms of $R^1$ is different from that of $R^2$ can be used as the amide compound represented by the general formula (1). A mixture of compounds in which $R^1$ and $R^2$ are alkyl groups having 16 or 18 carbon atoms is suitable as the mixture. In this case, the ratio (molar ratio) of the alkyl group having 16 carbon atoms and the alkyl group having 18 carbon atoms in the mixture is preferably 1:99 to 49:51. The reduction of the intermetallic friction coefficient and the prolongation of the shudder life can be achieved in a higher level by setting the ratio to the above range.

The amide compound represented by the general formula (1) can be obtained by the reaction of glycolic acid and dialkylamine represented by $R^1R^2NH$ (the contents of the definition of $R^1$ and $R^2$ are the same as those of the case of the general formula (1)). This reaction can be represented by the following formula (2).

[Chemical Formula 1]

(2)

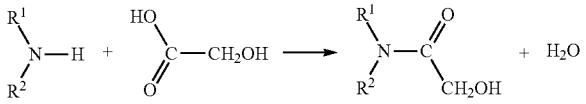

The dialkylamine represented by $R^1R^2NH$ which is a raw material can be synthesized according to reaction schemes represented by the following formulae (3) and (4). Carboxylic acid which is a raw material is deoxided to alcohol in the following formula (3), and the dialkylamine is synthesized by the dehydration condensation of the produced alcohol and ammonium in the following formula (4).

[Chemical Formula 2]

(3)

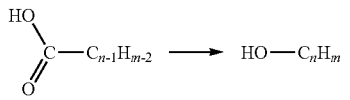

(4)

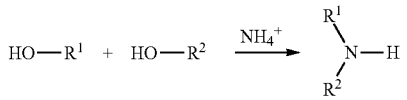

($R^1$, $R^2$ = $C_nH_m$)

The additive for lubricating oil according to the embodiment may contain only the amide compound represented by the general formula (1) or may be a mixture of the amide compound represented by the general formula (1) and other additive. The other additive used in combination will be described in detail in the description of a second embodiment.

Second Embodiment

Lubricating Oil Composition

A lubricating oil composition according to a second embodiment of the present invention contains a lubricating base oil containing a mineral base oil and/or a synthetic base oil, and an amide compound represented by the above general formula (1). A mode containing the above lubricating base oil and the additive for lubricating oil according to the first embodiment is included in the lubricating oil composition according to the embodiment.

The lubricating base oil in the embodiment is not particularly limited, and a lubricating base oil used for a usual lubricating oil can be used as the lubricating base oil. Specifically, a mineral lubricating base oil, a synthetic lubricating base oil, or a mixture in which two or more lubricating base oils selected therefrom are mixed at any rate, or the like can be used.

Specific examples of the mineral lubricating base oil include a base oil refined by subjecting a lubricating oil distillate obtained by subjecting an atmospheric bottom oil obtained by atmospheric distillation of a crude oil to vacuum distillation to one or more processings such as solvent deasphalting, solvent extraction, hydrocracking, solvent dewaxing, and hydrorefining, or a base oil manufactured by a method for isomerizing a wax isomerizing mineral oil and GTL wax (Gas-to-liquid wax).

Specific examples of the synthetic lubricating oil include polybutene or a hydrogenated product thereof; poly-α-olefin such as 1-octene oligomer or 1-decene oligomer, or a hydrogenated product thereof; a diester such as ditridecyl glutarate, di-2-ethylhexyl adipate, diisodecyl adipate, ditridecyl adipate, or di-2-ethylhexyl sebacate; a polyol ester such as trimethylolpropane caprylate, trimethylolpropane pelargonate, pentaerythritol-2-ethylhexanoate, or pentaerythritol pelargonate; and an aromatic synthetic oil such as alkylnaphthalene or alkylbenzene, or a mixture thereof.

The kinematic viscosity of the lubricating base oil is not particularly limited, and the kinematic viscosity of the lubricating base oil at 100° C. is preferably equal to or less than 50 $mm^2/s$, more preferably equal to or less than 40 $mm^2/s$, still more preferably equal to or less than 20 $mm^2/s$, and particularly preferably equal to or less than 10 $mm^2/s$. When the kinematic viscosity of the lubricating base oil at 100° C. is greater than 50 $mm^2/s$, a low-temperature viscosity characteristic tends to be insufficient. The kinematic viscosity of the lubricating base oil at 100° C. is preferably equal to or greater than 1 $mm^2/s$, and more preferably equal to or greater than 2 $mm^2/s$. When the kinematic viscosity of the lubricating base oil at 100° C. is less than 1 $mm^2/s$, oil film formation at lubricated sites tends to be insufficient, resulting in inferior lubricity and a large evaporation loss amount of the lubricating base oil.

The viscosity index of the lubricating base oil is not particularly limited, and is preferably equal to or greater than 80 from the view point of the low-temperature viscosity characteristic. From the view point of obtaining an excellent viscosity characteristic in a wide temperature range from a low temperature to a high temperature, the viscosity index of the lubricating base oil is more preferably equal to or greater than 100, still more preferably equal to or greater than 110, and particularly preferably equal to or greater than 120.

The sulfur content of the lubricating base oil is not particularly limited, and is preferably equal to or less than 0.1% by mass, more preferably equal to or less than 0.01% by mass, still more preferably equal to or less than 0.005% by mass, and particularly preferably substantially free (equal to or less than 0.001% by mass). The term "sulfur content" referred in the present invention means a value measured in accordance with JIS K 2541-4 "Energy-dispersive X-ray fluorescence method" (usually, a range of 0.01 to 5% by mass) or JIS K 2541-5 "Bomb Mass Determination Method, Appendix (Regulations), Inductively Coupled Plasma Spectrophotometry" (usually, equal to or greater than 0.05% by mass).

The total aromatic content of the lubricating base oil is not particularly limited, and is preferably equal to or less than 30% by mass, more preferably equal to or less than 15% by mass, still more preferably equal to or less than 5% by mass, and particularly preferably 2% by mass. When the total aromatic content of the lubricating base oil is greater than 30% by mass, oxidation stability tends to be insufficient. The term "total aromatic content" referred in the present invention means an aromatic fraction content determined in accordance with ASTM D2549. Usually, the aromatic fraction includes alkylbenzene; alkylnaphthalene; anthracene, phenanthrene, and an alkylated product thereof; a compound in which four or more benzene rings are condensated to each other; or compounds having heteroaromatics such as pyridines, quinolines, phenols, or naphthols.

The NOACK evaporation amount of the lubricating base oil is not particularly limited, and is preferably 2 to 70% by mass, more preferably 5 to 60% by mass, still more preferably 20 to 50% by mass, and particularly preferably 25 to 50% by mass. The term "NOACK evaporation amount" referred in the present invention means an evaporation loss amount measured in accordance with ASTM D 5800-95.

The specific aspect and a preferred aspect of the amide compound represented by the general formula (1) in the embodiment are the same as those in the case of the first embodiment, and duplicate description thereof will be omitted here.

The content of the amide compound represented by the general formula (1) in the embodiment is preferably 0.01 to 0.5% by mass in terms of a nitrogen atom based on the total amount of the lubricating oil composition, more preferably 0.01 to 0.25% by mass, and particularly preferably 0.02 to 0.1% by mass. The reduction of the intermetallic friction coefficient and the prolongation of the shudder life can be achieved in a higher level by setting the content to the above range. When the content is less than 0.01% by mass, the improvement effect of the shudder life is lack. On the other hand, when the content is greater than 0.5% by mass, the intermetallic friction coefficient may be reduced.

The lubricating oil composition according to the embodiment can further contain the following additives in addition to the above constituent components.

The lubricating oil composition according to the embodiment can further contain a wear-resistant agent (also referred to as an extreme-pressure agent). As the wear-resistant agent, any wear-resistant agent used for the lubricating oil can be used. For example, a sulfur extreme-pressure agent, a phosphorus extreme-pressure agent, and a sulfur-phosphorus extreme-pressure agent can be used; and specific examples thereof include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamate, zinc dithiocarbamate, molybdenum dithiocarbamate, disulfides, polysulfides, olefin sulfides, and sulfurized fats and oils.

Preferably, the lubricating oil composition according to the embodiment further contains a phosphorus additive as the wear-resistant agent. A phosphorus compound represented by the following general formula (5) or a derivative thereof can be preferably used as the phosphorus additive.

[Chemical Formula 3]

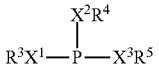

(5)

In the general formula (5), $R^3$ and $R^4$ represent a straight-chain type alkyl group having 11 to 20 carbon atoms. $R^3$ and $R^4$ are preferably straight-chain type alkyl groups having 12 to 18 carbon atoms. Examples of the straight-chain type alkyl group having 11 to 20 carbon atoms include an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group.

In the general formula (5), $R^5$ represents a hydrogen atom or a straight-chain type alkyl group having 11 to 20 carbon atoms. Specific examples of the straight-chain type alkyl group having 11 to 20 carbon atoms are the same as those in the case of $R^3$ and $R^4$.

When $R^3$, $R^4$, or $R^5$ is other than the above groups, an intermetallic friction characteristic between a belt and a pulley may be reduced. Therefore, the case is not preferable.

In the general formula (5), $X^1$, $X^2$, and $X^3$ each represents an oxygen atom or a sulfur atom, and preferably an oxygen atom.

Specific examples of the derivative of the phosphorus compound represented by the general formula (5) include a salt in which a phosphorus compound such as hydrogenated phosphorous acid ester (hydrogen phosphite) or hydrogenated thiophosphorous acid ester (hydrogen thiophosphite) in which $R^5$ in the formula (5) is a hydrogen atom is subjected to a nitrogen-containing compound such as ammonia or an amine compound containing only a hydrocarbon group or hydroxyl group-containing hydrocarbon group having 1 to 8 carbon atoms in a molecule, to neutralize a part or all of remaining acidic hydrogen. Specific examples thereof include ammonia; an alkylamine such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine, or dioctylamine (an alkyl group may be straight-chain or branched); an alkanolamine such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine, or dioctanolamine (an alkanol group may be straight-chain or branched); and a mixture thereof.

From the view point that the intermetallic friction characteristic between the belt and the pulley is more excellent, a phosphorous acid ester (hydrogen phosphite) and a thiophosphorous acid ester in which $R^5$ in the general formula (5) is hydrogen, or the amine salts and alkanolamine salts of the phosphorus compounds, or the like are more preferably used as the phosphorus additive. More specifically, dialkyl hydrogen phosphite such as di-n-undecyl hydrogen phosphite, di-n-dodecyl hydrogen phosphite, di-n-tridecyl hydrogen phosphite, di-n-tetradecyl hydrogen phosphite, di-n-pentadecyl hydrogen phosphite, di-n-hexadecyl hydrogen phosphite, di-n-heptadecyl hydrogen phosphite, di-n-octadecyl hydrogen phosphite, di-n-nonadecyl hydrogen phosphite, or di-n-icosyl hydrogen phosphite; trialkyl hydrogen phosphite such as tri-n-undecyl hydrogen phosphite, tri-n-dodecyl hydrogen phosphite, tri-n-tridecyl hydrogen phosphite, tri-n-tetradecyl hydrogen phosphite, tri-n-pentadecyl hydrogen phosphite, tri-n-hexadecyl hydrogen phosphite, tri-n-heptadecyl hydrogen phosphite, tri-n-octadecyl hydrogen phosphite, tri-n-nonadecyl hydrogen phosphite, or tri-n-icosyl hydrogen phosphate; or mixtures of the amine salts thereof, alkanolamine salts thereof, or the phosphorus compounds are preferable.

In the lubricating oil composition according to the embodiment, the content of the phosphorus additive is preferably equal to or greater than 0.005% by mass in terms of phosphorous element based on the total amount of the lubricating oil composition, more preferably equal to or greater than 0.01% by mass, and still more preferably equal to or greater than 0.015% by mass. The content is preferably equal to or less than 0.1% by mass, more preferably equal to or less than 0.08% by mass, and still more preferably equal to or less than 0.07% by mass. When the content of the phosphorus additive is less than 0.005% by mass, the improvement effect of the intermetallic friction coefficient between the belt and the pulley is lack. On the other hand, when the content is greater than 0.1% by mass, the oxidation stability of the lubricating oil composition may be reduced or the durability of a seal material and a resin material or the like may be adversely affected. Therefore, both the cases are not preferable.

The lubricating oil composition according to the embodiment can further contain a metal cleaning agent. A calcium-based metal cleaning agent is suitable as the metal cleaning agent, and specific examples thereof include a normal salt, a basic salt, or a perbasic salt of sulfonate, phenate, or salicylate or the like. Any one of the metal cleaning agents can be used alone, or two or more thereof can be used in combination.

When the calcium-based metal cleaning agent is used in the lubricating oil composition according to the embodiment, the content thereof is preferably equal to or greater than 0.005% by mass in terms of calcium element based on the total amount of the lubricating oil composition, more preferably equal to or greater than 0.01% by mass, and still more preferably equal to or greater than 0.015% by mass. The content is preferably equal to or less than 0.1% by mass, more preferably equal to or less than 0.08% by mass, and still more preferably equal to or less than 0.07% by mass. When the content of the calcium-based metal cleaning agent is less than 0.005% by mass, the improvement effect of the intermetallic friction coefficient is lack. On the other hand, when the content is greater than 0.1% by mass, the shudder life may be shortened. Therefore, both the cases are not preferable.

The lubricating oil composition according to the embodiment can further contain an ashless dispersant. Any ashless dispersant such as alkenyl succinimide, benzylamine, or alkenyl polyamine which is used for the lubricating oil can be used as the ashless dispersant. Examples thereof include mono-succinicimide in which a straight-chain type or branching type alkyl or alkenyl succinic anhydride having 40 to 400 carbon atoms is added to one end of polyamine in imidizing and which is represented by the following general formula (6), or bis-succinimide in which the straight-chain type or branching type alkyl or alkenyl succinic anhydride is added to both ends of polyamine and which is represented by the following general formula (7).

[Chemical Formula 4]

(6)

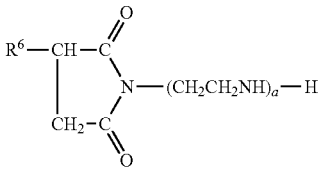

(7)

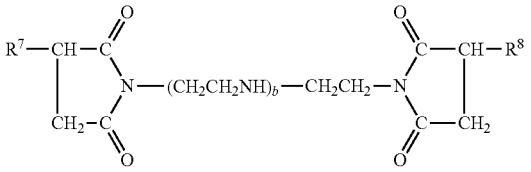

In the general formulae (6) and (7), $R^6$, $R^7$, and $R^8$ each independently represent a straight-chain type or branching type alkyl group or alkenyl group having 40 to 400 carbon atoms, and preferably 60 to 350 carbon atoms. a is an integer of 1 to 10, and preferably 2 to 5; and b is an integer of 0 to 10, and preferably 1 to 5.

Alternatively, boron-modified succinimide in which a boron compound such as boric acid (orthoboric acid, metaboric acid, or tetraboric acid or the like), a borate salt, or a boric acid ester is subjected to the succinicimide, or the like can be also used.

A method for manufacturing the above succinicimide is not specifically limited, and the succinicimide is obtained by, for example, reacting alkylsuccinic acid or alkenyl succinic acid obtained by reacting a compound having an alkyl group or an alkenyl group having 40 to 400 carbon atoms with maleic anhydride at 100 to 200° C., with polyamine.

Examples of the polyamine include diethylene triamine, triethylene tetramine, tetraethylene pentamine, and pentaethylene hexamine.

In the lubricating oil composition according to the embodiment, the content of the ashless dispersant is preferably equal to or greater than 0.5% by mass based on the total amount of the lubricating oil composition, more preferably equal to or greater than 1.0% by mass, and still more preferably equal to or greater than 2.0% by mass. The content is preferably equal to or less than 8.0% by mass based on the total amount of the lubricating oil composition, more preferably equal to or less than 7.0% by mass, and still more preferably equal to or less than 6.0% by mass. When the content of the ashless dispersant is less than the lower limit based on the total amount of the lubricating oil composition, the improvement effect of the intermetallic friction coefficient is lack. On the other hand, when the content is greater than the upper limit, an initial shudder-preventing property and the shudder life may be reduced. Therefore, both the cases are not preferable.

In order to further improve the performance, the lubricating oil composition according to the embodiment can contain any additive generally used for the lubricating oil according to the purpose. Examples of the additive include additives such as an antioxidant, a wear-resistant agent (or an extreme-pressure agent), a corrosion inhibitor, a rust inhibitor, a viscosity index improver, a pour point depressant, an antiemulsifier, a metal deactivator, an antifoaming agent, and an ash-free friction modifier.

Examples of the antioxidant include an ash-free antioxidant such as a phenol ash-free antioxidant or an amine ash-free antioxidant, or a metallic antioxidant such as a zinc antioxidant, a copper antioxidant, or a molybdenum antioxidant.

Preferable examples of the phenol antioxidant include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, and octyl-3-(3-methyl-5-di-tert-butyl-4-hydroxyphenyl)propionate. These may be used in the form of a mixture of two or more thereof.

Examples of the amine antioxidant include a known amine antioxidant generally used as the lubricating oil, such as an aromatic amine compound, alkyldiphenylamine, alkylnaphthylamine, phenyl-α-naphthylamine, or alkylphenyl-α-naphthylamine.

Examples of the corrosion inhibitor include a benzotriazole type, tolyltriazole type, thiadiazole type, or imidazole type compound.

Examples of the rust inhibitor include petroleum sulfonate, alkylbenzenesulfonate, dinonylnaphthalene sulfonate, an alkenyl succinic acid ester, or a polyhydric alcohol ester.

The viscosity index improver can include usual general non-dispersion type or dispersion type poly(meth)acrylate, a non-dispersion type or dispersion type ethylene-α-olefin copolymer or a hydrogenated product thereof, polyisobutylene or a hydrogenated product thereof, and a styrene-diene hydrogenated copolymer, and can further contains a styrene-anhydrous maleic acid ester copolymer and polyalkyl styrene, or the like. The weight average molecular weight of these viscosity index improvers is usually 800 to 1,000,000, and preferably 100,000 to 900,000.

Examples of the metal deactivator include imidazoline, a pyrimidine derivative, alkylthiadiazole, mercaptobenzothiazole, benzotriazole or a derivative thereof, 1,3,4-thiadiazole-polysulfide, 1,3,4-thiaziazolyl-2,5-bisdialkyldithiocarbamate, 2-(alkyldithio)benzoimidazole, or β-(o-carboxybenzylthio)propionenitrile.

Examples of the antifoaming agent include a silicone oil, an alkenyl succinic acid derivative, an ester of polyhydroxy-aliphatic alcohol and long-chain fatty acid, methyl salicylate, and o-hydroxybenzyl alcohol whose kinematic viscosity at 25° C. is 1000 to 100,000 $mm^2/s$.

As the ash-free friction modifier, any compound usually used as the ash-free friction modifier for the lubricant oil can be used, and examples thereof include an ash-free friction modifier such as an amine compound, a fatty acid ester, a fatty acid amide, fatty acid, aliphatic alcohol, or an aliphatic ether having at least one of an alkyl group or alkenyl group with 6 to 30 carbon atoms, particularly a straight-chain type alkyl group and straight-chain type alkenyl group with 6 to 30 carbon atoms in the molecule. A nitrogen-containing compound and an acid-modified derivative thereof described in Japanese Patent Application Laid-Open Publication No. 2009-286831, or the like and various ash-free friction modifiers exemplified in Japanese Patent Application National Publication (Laid-Open) No. 2005-037967 Pamphlet can be also used.

When these additives are contained in the lubricating oil composition according to the embodiment, the contents thereof are preferably 0.01 to 20% by mass based on the total amount of the composition.

When the lubricating oil composition according to the embodiment contains the amide compound represented by the general formula (1) and other additive, and the lubricating oil composition is prepared, the amide compound represented by the general formula (1) and the other additive may be previously mixed, and the mixture may be added to the lubricating base oil. Alternatively, the amide compound represented by the general formula (1) and the other additive may be added separately to the lubricating base oil.

The kinematic viscosity of the lubricating oil composition at 100° C. according to the embodiment is not particularly limited, and is preferably 3.8 to 21.9 $mm^2/s$, more preferably 4.1 to 16.3 $mm^2/s$, and particularly preferably 5.6 to 12.5 $mm^2/s$. The kinematic viscosity at 100° C. here designates the kinematic viscosity at 100° C. specified by ASTM D-445.

EXAMPLES

Hereinafter, based on Examples and Comparative Examples, the present invention will be more specifically described, but the present invention will not be limited to Examples below.

Examples 1 to 4 and Comparative Examples 1 to 7

In Examples 1 to 4 and Comparative Examples 1 to 7, lubricating oil compositions having compositions shown in Table 1 were prepared using a lubricating base oil and additives shown below.

(1) Lubricating Base Oil

Base Oil 1: hydrogenated refined mineral oil (kinematic viscosity at 100° C.: 4.2 $mm^2/s$, viscosity index: 122, S amount: equal to or less than 0.1% by mass, NOACK evaporation amount: 15% by mass)

(2) Additives

Amide Additive (A-1): A reaction product (an amide additive represented by the general formula (1) and containing an amide compound in which $R^1$ and $R^2$ are n-octadecyl groups or n-hexadecyl groups as the main component, alkyl group composition (molar ratio):n-octadecyl group/n-hexadecyl group/other alkyl group=66:30:4) of glycolic acid (Glycolic Acid manufactured by Tokyo Kasei Kogyo Co., Ltd.) and amine (Farmin D86 manufactured by Kao Corporation) containing octadecylamine as the main component Amide Additive (A-2): A reaction product of glycolic acid (Glycolic Acid manufactured by Tokyo Kasei Kogyo Co., Ltd.) and dioctylamine (Di-n-octylamine manufactured by Tokyo Kasei Kogyo Co., Ltd.)

Amide Additive (A-3): A reaction product of glycolic acid (Glycolic Acid manufactured by Tokyo Kasei Kogyo Co., Ltd.) and didodecylamine (Didodecylamine manufactured by Tokyo Kasei Kogyo Co., Ltd.)

Amide Additive (A-4): A reaction product of glycolic acid (Glycolic Acid manufactured by Tokyo Kasei Kogyo Co., Ltd.) and di(2-ethylhexyl)amine (Di(2-ethylhexyl)amine manufactured by Tokyo Kasei Kogyo Co., Ltd.)

C-1: Alkylphosphite (P Content: 16% by mass)

D-1: Calcium Sulfonate (Calcium Content: 12% by mass, Base Number: 300 mgKOH/g)

E-1: Ashless Dispersant (Non-Borated Succinicimide/Borated Succinicimide)

F-1: Additive Package (including a viscosity index improver, an antioxidant, an antifoaming agent, and a rubber swelling agent)

The following tests were carried out using lubricating oil compositions of Examples 1 to 4 and Comparative Examples 1 to 7.

(1) Shudder Life (Transmission Characteristic)

A shudder life was measured using SAE No. 2 Tester in accordance with JASO M348-95 "Test method for friction property of automatic transmission fluids" for a transmission characteristic. The obtained results are shown in Table 1.

(2) Measurement of Intermetallic Friction Coefficient

In order to evaluate an intermetallic friction characteristic between a belt and a pulley in a metal belt type continuous variable transmission, LFW-1 friction test was conducted under conditions shown below in accordance with "Standard Test Method for Calibration and Operation of Falex Block-on-Ring Friction and Wear Testing Machine" prescribed in ASTMD2714-94, to measure the intermetallic friction coefficient. The obtained results are shown in Table 1.

[Test Conditions]

Ring: Falex S-10 Test Ring (SAE 4620 Steel)

Block: Falex H-60 Test Block (SAE 01 Steel)

Test Oil temperature: 80° C.

Slipping velocity: 0.2 cm/s

Test Load: 500 N

TABLE 1

| | | Example 1 | Comparative Example 1 | Comparative Example 2 | Comparative Example 3 | Comparative Example 4 |
|---|---|---|---|---|---|---|
| Base oil 1 | % by mass | 86.6 | 87.0 | 86.8 | 87.0 | 87.4 |
| Amide additive (A-1) | % by mass | 0.8 | — | — | — | — |
| Amide additive (A-2) | % by mass | — | 0.4 | — | — | — |
| Amide additive (A-3) | % by mass | — | — | 0.6 | — | — |
| Amide additive (A-4) | % by mass | — | — | — | 0.4 | — |
| Alkyl phosphite (C-1) | % by mass | 0.3 | 0.3 | 0.3 | 0.3 | 0.3 |
| Calcium sulfonate (D-1) | % by mass | 0.3 | 0.3 | 0.3 | 0.3 | 0.3 |
| Ashless dispersant (E-1) | % by mass | 4.8 | 4.8 | 4.8 | 4.8 | 4.8 |
| Additive package (F-1) | % by mass | 7.2 | 7.2 | 7.2 | 7.2 | 7.2 |
| N amount derived from amide additive | % by mass | 0.02 | 0.02 | 0.02 | 0.02 | 0.00 |
| P content | % by mass | 0.05 | 0.05 | 0.05 | 0.05 | 0.05 |
| Ca content | % by mass | 0.04 | 0.04 | 0.04 | 0.04 | 0.04 |
| Shudder life | h | 500 | 25 | 100 | 0 | 0 |
| Intermetallic friction coefficient | | 0.118 | 0.120 | 0.118 | 0.121 | 0.123 |

TABLE 2

| | | Example 2 | Example 3 | Example 4 | Comparative Example 5 | Comparative Example 6 | Comparative Example 7 |
|---|---|---|---|---|---|---|---|
| Base oil 1 | % by mass | 84.6 | 84.4 | 84.3 | 85.9 | 85.4 | 85.9 |
| Amide additive (A-1) | % by mass | 2.8 | 2.8 | 2.8 | — | — | — |
| Amide additive (A-2) | % by mass | — | — | — | 1.5 | — | — |
| Amide additive (A-3) | % by mass | — | — | — | — | 2.0 | — |
| Amide additive (A-4) | % by mass | — | — | — | — | — | 1.5 |
| Alkyl phosphite (C-1) | % by mass | 0.3 | 0.5 | 0.3 | 0.3 | 0.3 | 0.3 |
| Calcium sulfonate (D-1) | % by mass | 0.3 | 0.3 | 0.5 | 0.3 | 0.3 | 0.3 |
| Ashless dispersant (E-1) | % by mass | 4.8 | 4.8 | 4.8 | 4.8 | 4.8 | 4.8 |
| Additive package (F-1) | % by mass | 7.2 | 7.2 | 7.2 | 7.2 | 7.2 | 7.2 |
| N amount derived from amide additive | % by mass | 0.07 | 0.07 | 0.07 | 0.07 | 0.07 | 0.07 |
| P content | % by mass | 0.05 | 0.08 | 0.05 | 0.05 | 0.05 | 0.05 |
| Ca content | % by mass | 0.04 | 0.04 | 0.08 | 0.04 | 0.04 | 0.04 |
| Shudder life | h | >600 | 400 | 350 | 100 | 200 | 0 |
| Intermetallic friction coefficient | | 0.110 | 0.112 | 0.112 | 0.116 | 0.112 | 0.118 |

The invention claimed is:

1. A lubricating oil composition comprising:

a lubricating base oil comprising at least one selected from the group of a mineral base oil and a synthetic base oil;

a mixture of amide compounds represented by the following formula (1):

$$R^1R^2N—COCH_2OH \quad (1)$$

wherein $R^1$ and $R^2$ may be the same or different and each represents an alkyl group having 16 to 22 carbon atoms, wherein a molar ratio of alkyl groups having 16 carbon atoms to alkyl groups having 18 carbon atoms in the mixture is 1:99 to 49:51, and wherein a content of the mixture of amide compounds is 0.01 to 0.1% by mass in terms of a nitrogen atom based on the total amount of the lubricating oil composition; and an alkyl phosphite:

wherein a content of the alkylphosphite is 0.005 to 0.1% by mass in terms of a phosphorous atom and based on the total amount of the lubricating oil composition.

* * * * *